US005440294A

United States Patent [19]

Mercier et al.

[11] Patent Number: 5,440,294

[45] Date of Patent: Aug. 8, 1995

[54] MAIL DELIVERY SIGNAL SYSTEM

[76] Inventors: Ellen L. Mercier; Carl E. Mercier, both of 36909 Lisbon Rd., Oconomowoc, Wis. 53066

[21] Appl. No.: 63,643

[22] Filed: May 20, 1993

[51] Int. Cl.[6] ..... G08B 21/00

[52] U.S. Cl. ..... 340/569; 200/61.63; 232/35; 232/36; 232/37; 340/539

[58] Field of Search ..... 340/569, 539; 232/35, 232/36, 37; 200/61.63

[56] References Cited

U.S. PATENT DOCUMENTS

| | | | |
|---|---|---|---|
| 1,021,100 | 3/1912 | Hopkins | 340/569 |
| 1,037,470 | 9/1912 | Grindle | 340/569 |
| 1,157,949 | 10/1915 | Miller | 340/569 |
| 1,442,578 | 1/1923 | Landrum | 340/569 |
| 2,477,379 | 7/1949 | Korth | 340/569 |
| 2,480,288 | 8/1949 | Donadio | 340/569 |
| 2,759,057 | 8/1956 | Whildin et al. | 340/569 |
| 2,834,539 | 5/1958 | Carey | 232/35 |
| 3,009,139 | 11/1961 | Hill, Jr. | 340/569 |
| 3,040,141 | 6/1962 | Whildin et al. | 200/61.03 |
| 3,556,394 | 1/1971 | Caldes | 232/36 |
| 3,572,581 | 3/1971 | McLeod | 232/35 |
| 3,611,333 | 10/1971 | Conigliaro | 340/569 |
| 3,707,260 | 12/1972 | Gelineau, Sr. et al. | 232/36 |
| 4,101,877 | 7/1978 | Rush | 340/569 |
| 4,287,514 | 9/1981 | Wartman et al. | 340/569 |
| 4,520,350 | 5/1985 | Huang | 340/569 |
| 4,633,236 | 12/1986 | Buhl | 340/569 |
| 4,792,796 | 12/1988 | Bradshaw et al. | 340/539 |
| 4,794,377 | 12/1988 | Benages | 340/569 |
| 4,868,543 | 9/1989 | Binkley | 340/569 |
| 4,872,210 | 10/1989 | Benages | 340/569 |
| 5,023,595 | 6/1991 | Bennett | 340/569 |

*Primary Examiner*—Glen Swann

*Attorney, Agent, or Firm*—Ryan, Kees & Hohenfeldt

[57] ABSTRACT

A system for remotely sensing the delivery of mail to a mailbox uses a transmitter mounted on the mailbox. The transmitter generates a prescribed signal when the door of the mailbox is opened. The system also uses a receiver adapted for placement at a location remote from the transmitter. The receiver has two receiving circuits. The first receiver circuit generates a mail arrival output in response to receipt of the prescribed signal from the transmitter. The first receiver circuit maintains the generation of the mail arrival output regardless of continued receipt of the prescribed signal, until receipt of a prescribed termination command entered by the user. This way, the user knows when the mailbox door has been opened. The second receiver circuit generates a receiver locator output separate from the mail arrival output in response to receipt of the prescribed signal from the transmitter. Unlike the first receiver circuit, the second receiver circuit automatically terminates the receiver locator output in the absence of receipt of the prescribed signal after a predetermined time period. The temporal receiver locator output indicates when the receiver is placed in the remote location for good reception of the prescribed signal.

11 Claims, 7 Drawing Sheets

FIG.2
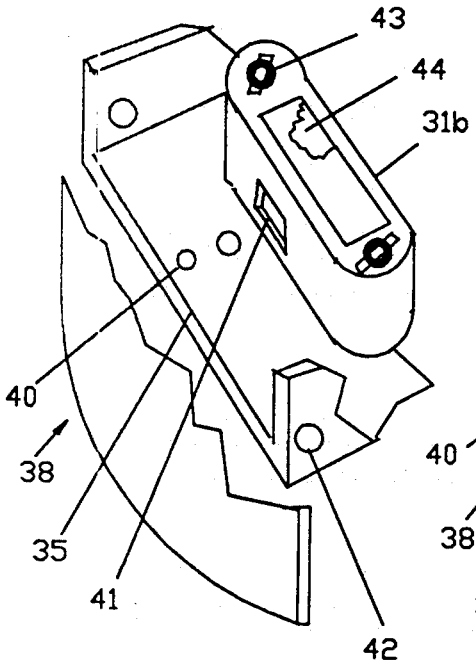
FIG.3
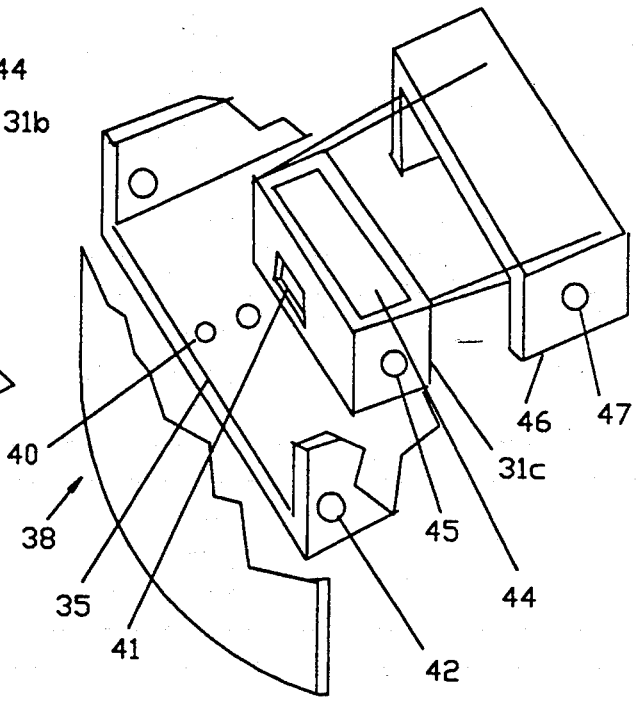
FIG.4
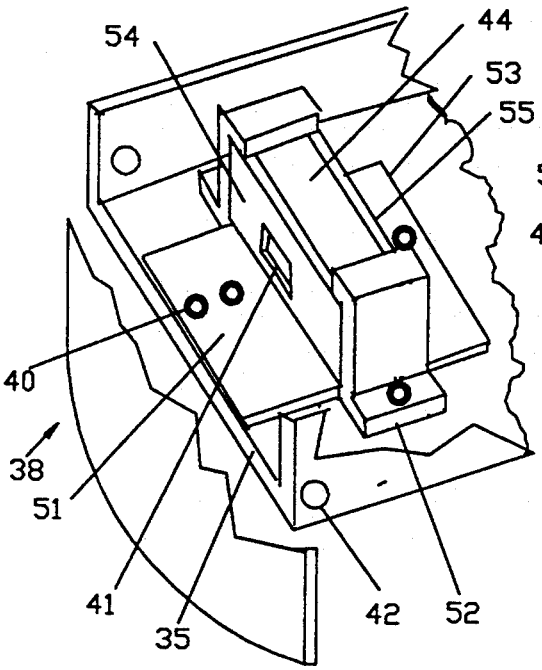
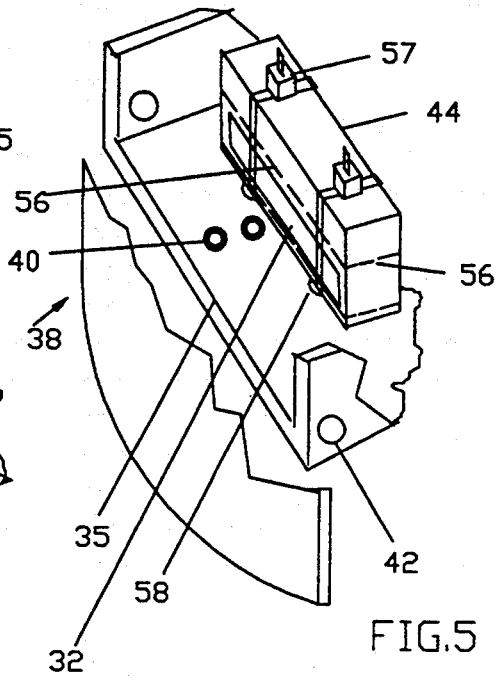
FIG.5

FIG.6
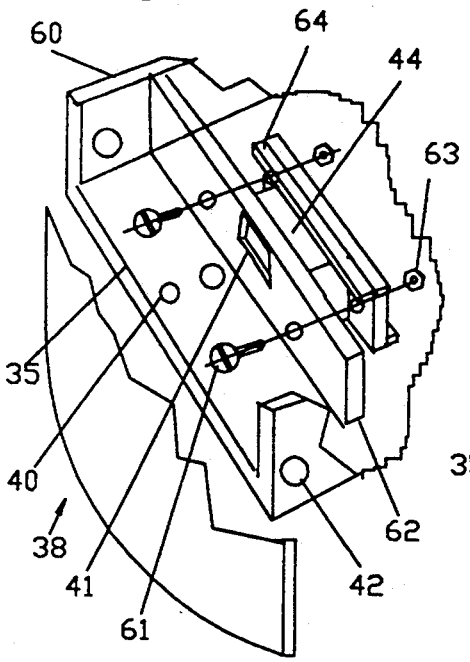
FIG.7
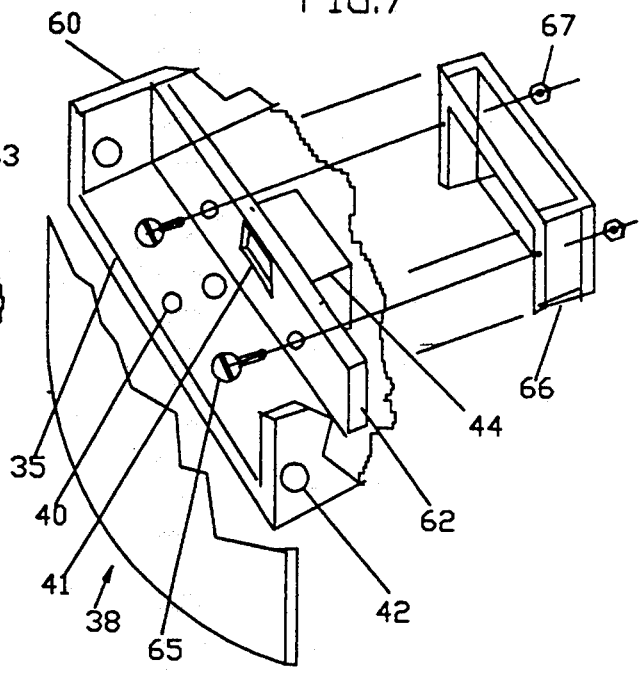
FIG.8
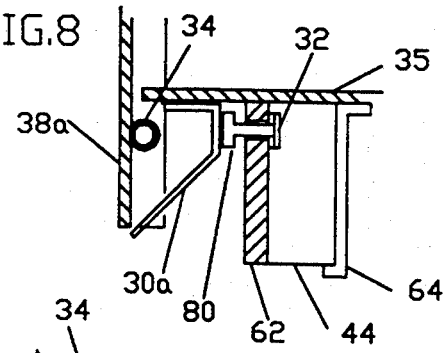
FIG.9
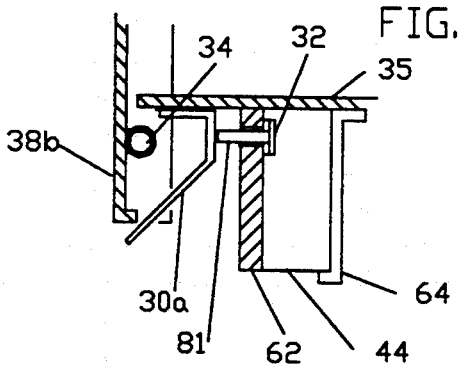
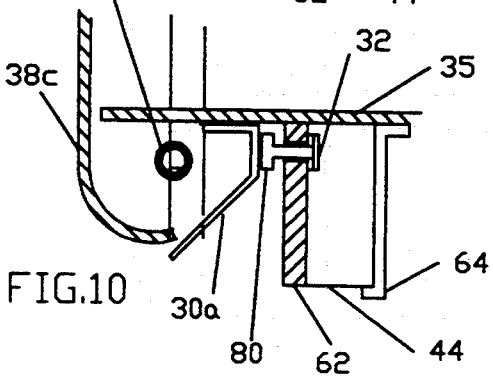
FIG.10
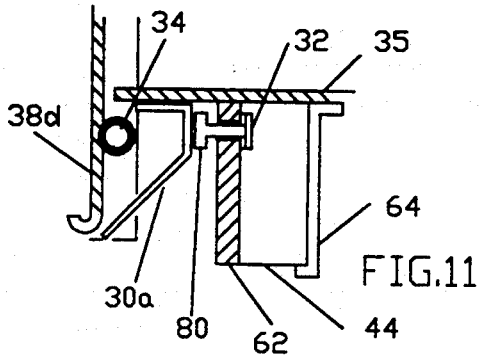
FIG.11

FIG.12
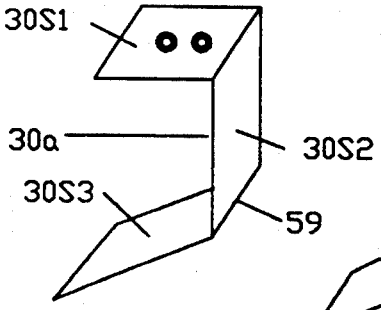
FIG.13
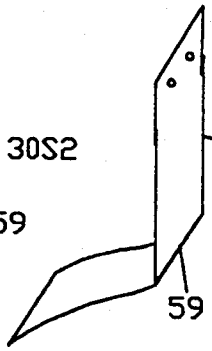
FIG.14
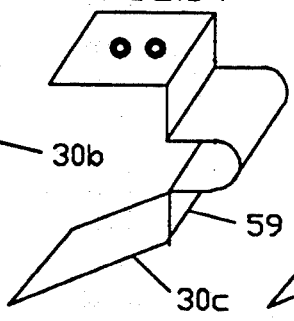
FIG.15
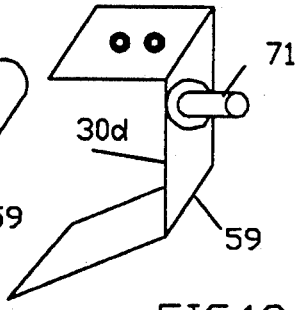
FIG.16
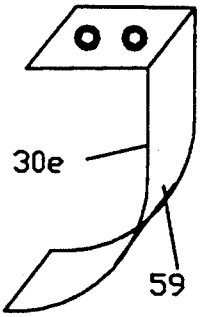
FIG.17
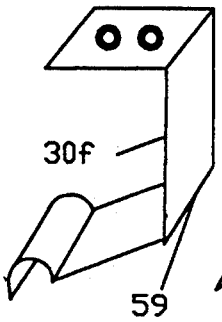
FIG.18
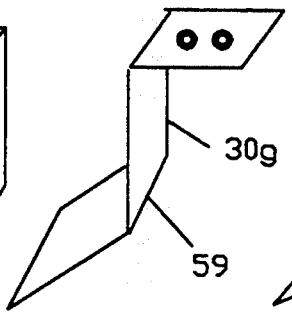
FIG.19
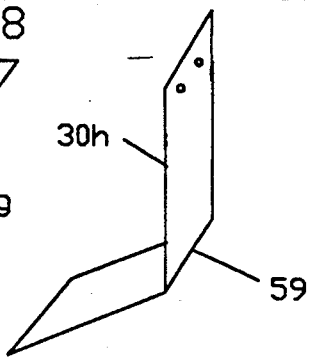
FIG.20
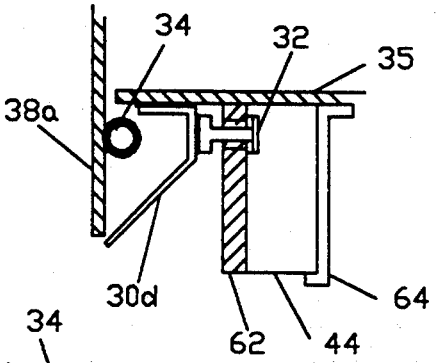
FIG.21
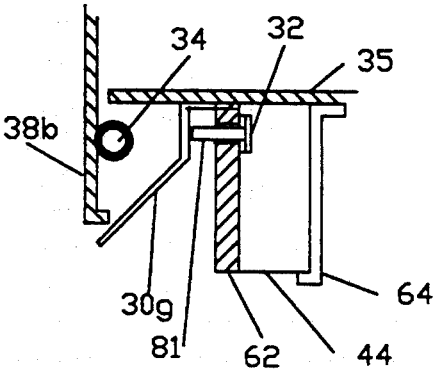
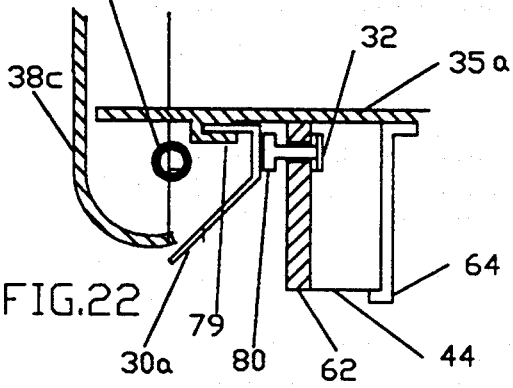
FIG.22
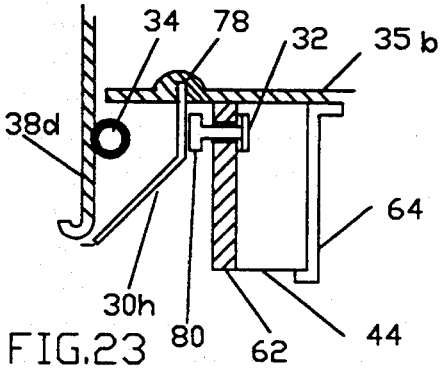
FIG.23

FIG.24
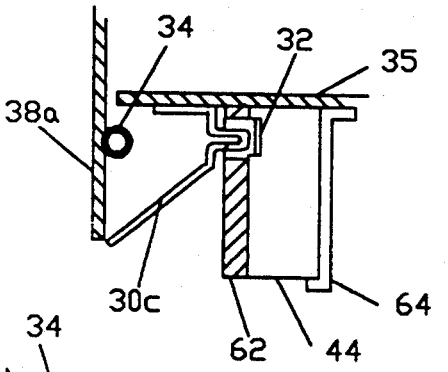
FIG.25
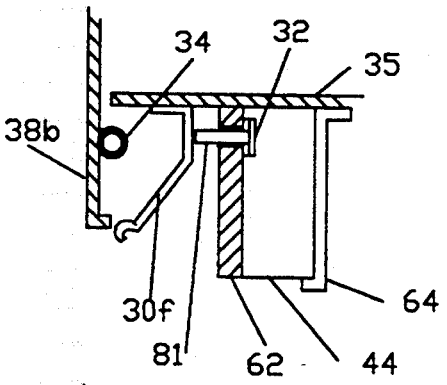
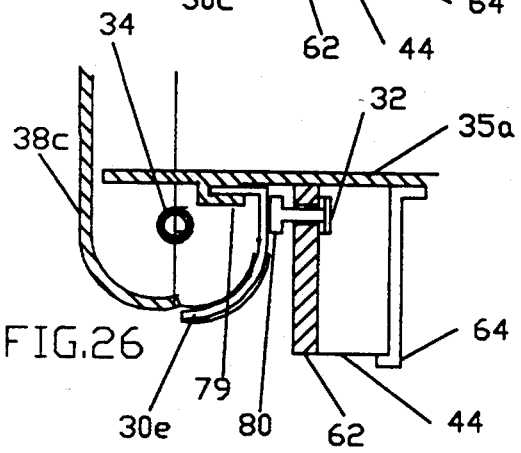
FIG.26
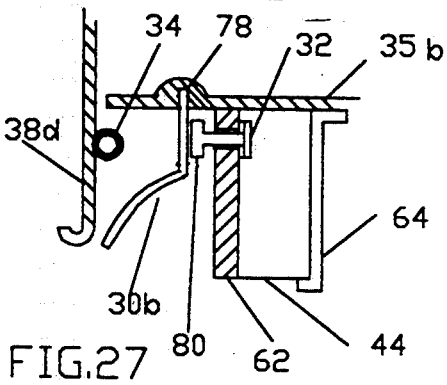
FIG.27
FIG.28
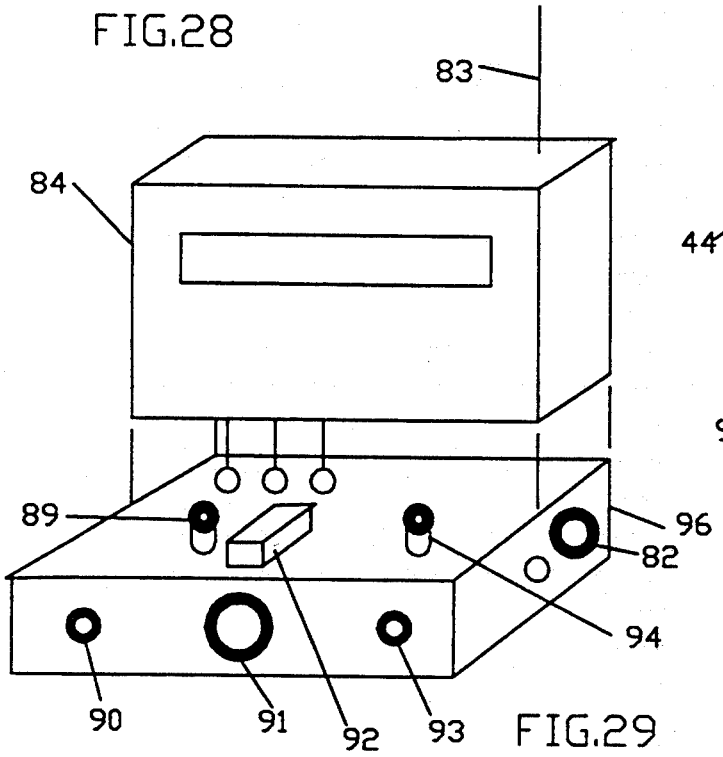
FIG.29
FIG.31
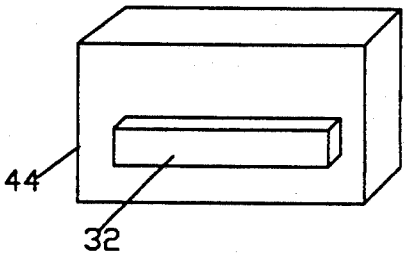
FIG.30
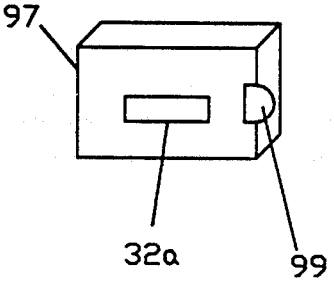

MAIL DELIVERY SIGNAL SYSTEM

FIELD OF THE INVENTION

This invention relates to apparatus which signals to a business or residence the arrival of mail deposited into a rural mail box,

Background of the Invention:

There is a need for a business or residence to be alerted when mail delivery occurs. A signal system in desirable for locations where it is difficult to view the mail box and also for handicap persons to avoid unnecessary trips to the mail box, To discuss the following prior art, a brief discussion of the rules and regulations of the U.S. Postmaster General and the F.C.C. is as follows:

(1) U.S. Postal Service: Domestic Mail Manual, Issue 44, Effective Sep. 20 1992, Section 150–151.53: Section 151,515 Production Units Manufacturers must construct production units in accordance with identified (stamped) drawings and USPS-STD-7.

(2) USPS-STD-7 Oct. 1985 Section 1-3.19.1.a, U.S. Postal Service Standard Boxes, Rural Mail Section 3.3.1, Last Sentence: The Door shall, once opened remain open until the carrier pushes it closed. Doors or any door attachments that reduce the useable area within the box are not acceptable.

(3) F.C.C. Rules 15 for Transmitters And receivers: Verification of rules per telephone conversation with Engineer at F.C.C. F.C.C. Equipment Authorization Branch, Columbia Md., Feb. 3, 1993 (Their Telephone Number 301-725-1585 Extension 230): If you modify an existing F.C.C. approved transmitter such as one, for example, used in garage door operators consisting of a case enclosing the high frequency electronic components, the battery and the push button switch then: (I)if you remove the original case, and put the components in a new case, the complete unit has to be re-tested and re-certified in the new case by the F.C.C; (ii) if you solder wires across the pushbotton switch and bring them out to another switch outside the case, the complete unit has to be re-tested and re-certified with the new, add on, wires with switch by the F.C.C.

A number of devices for providing mail delivery signals have been examined. A patent search of prior art has disclosed a number of patents as follows:

U.S. Pat. No. 552,062 issued Mar. 26, 1912 to Hopkins illustrates a signaling device for mail boxes. A switch inside the enclosure sends a signal by way of wire pairs to the bell located in the house. The switch has many parts that would be costly to build today. The external wiring would require Job site labor by a person experienced in electrics and would add considerable cost for the installation.

U.S. Pat. No. 1,037,470, issued Sep. 3, 1912 to Grinder illustrates a signaling device for mail boxes. A switch inside the enclosure sends a signal by way of wire pairs to the bell located in the house. The switch has many parts that would be costly to build today. The external wiring would require job site labor by a person experienced in electrics and would add considerable cost for the installation. The balancing of the pivoted end of the tilting bottom to exactly balance the free end thereof so that even a postal card deposited in the mail box and falling on the tilting bottom will cause the free end of the latter to swing down and actuate the switch as stated in the description would he prone to change of sensitivity due to wear change of temperature and deterioration due to friction.

U.S. Pat. No. 1,157,949 issued Oct. 26, 1915 to Miller illustrates a signaling device for mail boxes. A switch that sends out a coded signal to a bell located in side a residence is located inside the mail box. A disadvantage of this type of coded switch is that the coded signal is prone to error because it depends on how far the lid of the mailbox is opened. Another disadvantage of Millers mail box in that it requires external wiring which requires some one trained in electrics. This adds considerable cost to the installation.

U.S. Pat. No. 1,442,578 issued Jan. 16, 1923 to Landrum illustrates a signaling device for a mail box. A switch in a separate compartment is operated by the door and sends a signal to an external source. The external wiring required for Landrum's mailbox will add high cost to the installation.

U.S. Pat. No. 2,477,379 issued Jul. 26, 1949 to Korth illustrates a mail box having associated signaling systems by which deposit of the mail or the calling of a visitor may be announced. Korth's alarm system is prone to difficulty in remembering what mods of operation the signaling system is set, Because of the many moving parts, the maintenance cost would be high. Also, the installation cost would be high because of the external wiring required.

U.S. Pat. No. 2,480,288 issued Aug. 30, 1949 to Donadio illustrates a signaling type mail box and more particularly to apparatus for signaling that mail has been placed in the individual compartments of a mail box in a multiple apartment house. This type of signaling is very expensive due to the large amount of external wiring required, the maintenance cost would be high because of the large number of moving parts that would experience wear.

U.S. Pat. No. 2,759,057 issued Aug. 14, 1956 to Whildin ET AL illustrates a mail box alarms which are set off once in the door opening operation and then again when the door is closed. The operation of the switch is activated by the interaction of a cam and a spring leaf both of which are rigidly fixed, the cam to the door and the spring leaf to the mail box cavity. This type of switch actuator is prone to misalignment problems due to the make and break action of the, two piece, switch actuator. This signaling device is prone to high installation costs because of the external wiring needed. Another disadvantage of this signaling device is the exposure of wiring inside the delivery chamber which could be damaged when mail is inserted and withdrawn.

U.S. Pat. No. 3,009,139 issued Nov. 14, 1961 Hill illustrates a signaling device and more particularity to a signaling device adapted to be mounted adjacent a mail slot to provide a signal when an object is inserted through the mail slot. The disadvantage of this device is that the person has to be in audible range of the device. Another disadvantage of this device is high cost wiring has to be done by a person trained in electrical installation.

U.S. Pat. No. 3,040,141 issued Jun. 19, 1962 to Whildin ET AL illustrates a mail box alarms which are not off once in the door opening operation and then again when the door is closed. The operation of the switch is activated by the interaction of a cam and a spring leaf both of which are rigidly fixed, the cam to the door and the spring leaf to the mail box cavity. This type of switch actuator is prone to misalignment problems due to the make and break action of the two piece, switch actuator. This signaling device is prone to high installation costs because of the external wiring needed If the person is not home at the time of the, mail delivery, bell alarm and without memory retention of the device the device would be ineffective, U.S. Pat. No. 3,556,394 issued Jan. 19, 1971 to Caldes illustrates a rural mail box including an electrical warning system to let a rural resident know if anyone is tampering within his mail box, a warning system comprising an electrical circuit having an audible alarm in the house, a switch inside the door that energizes a electromagnet also located inside the door for sealing the door in a closed position. The electrical means for connecting the mail box to the residence is by under ground wiring, This device is prone to very high installation cost. Another disadvantage is the inside components are vulnerable to damage.

U.S. Pat. No. 3,572,581 issued Mar. 30, 1971 to McLeod illustrates a rural type mail box with two external signaling flags arranged in a switching system. Inside the box are slidable rods engage able with spring fingers on the pivotable door of the box. The rods are operatively connected to the flags by rotatable discs for holding one flag elevated and the other flag lowered when the door is closed and the rods are engaged with the spring fingers. A switch in the box is disposed for contact by a radial extension of one disc when the other flag is raised upon opening the door. A signal device such as a lamp or bell is connected in circuit with the switch to operate when the door is opened to rise the lowered other flag. The signaling device is wired to the residence. This device is too complicated for commercial success. There are too many moving parts to cause wear and misalignment. This device will cause interference with mail insertion. The wiring of this device will have high cost.

U.S. Pat. No. 3,611,333 issued Oct. 5, 1971 to Conigliaro illustrates a rural mail indicator signal system of the electric type comprising a miniature radio signal transmitter at the mail box, The transmitter sends out a pulse like signal when the mail box door is opened or closed. In the residence a miniature radio receiver intercepts the pulse signal and converts it to a visual and audible signal. The antenna for the transmitter is, either external to the mall box and also uses the metal mail box as an antenna. This design would require F.C.C. certification which is a major disadvantage over designs that use standard, off the shelf transmitters. Another disadvantage is that you are restricted to using metal mail boxes. Plastic mail boxes are becoming more acceptable. The snap action switch is prone to failure due to wear and corrosion. Also two operations of the switch, with only one close open operation of the door of the mail box door will give confusing data.

U.S. Pat. No. 3,707,260 issued Dec. 26, 1972 to Gelineau, Sr et al illustrates a rural route mail box having an insertable unit housing a remote signal transmitter and a rod and lower actuating mechanism to trigger the same on opening the box door to deliver or pick up mail. The unit is slideable into position with an enlarged transmitter housing portion located at the rear of the box, the rod and lever being arranged for push button like operation of the transmitter responsive to movement of the front door. The unit in the embodiment disclosed, is further slidable movable under spring pressure for transmitter operation in response to the opening of a door at the rear end of a box having an access opening at either end. This unit is prone to high cost due to a high number of parts. This unit will not meet U.S. Postal Standards because it is placed inside the mail box.

U.S. Pat. No. 4,101,877 issued Jul. 18, 1978 to Rush illustrates a system for activating a light and music box in the home when mail is deposited in a mail box located outside the home, and for deactivating the light and music box when the mail is removed. Switch means is provided inside the mail box and a circuit is arranged to activate the signals devices every time the switch means is closed. Additionally a signal-light is provided on the mail box to enable a visitor to find the proper home at night, and an electrically operated lock is provided for the mail box to prevent the mail from being stolen. This design is prone to high cost because of the excessive amount of external wiring required. This design is also prone to signal error because the mail man may reset the circuit by opening and closing the door twice with one delivery. Our mail man does this occasionally.

U.S. Pat. No. 4,872,210 issued Oct. 3, 1989 to Benages illustrates a signal device mounted on the inside of the door of a curbside mailbox. Opening and then closing the door closes a switch (mechanical switch, gravity actuated, a mercury switch or a photo diode) to emit a radio signal. A receiver in the residence, when actuated by the radio signal, notifies the occupant by an audible and/or visual signal. The disadvantage of this design is that this device requires wiring a switch to a radio frequency transmitter which would requirer F.C.C. approval. This is a major disadvantage because present, off the shelf, commercial successful, Garage door type transmitters can not be used in this application, thus prone to high cost. This device with a self contained antenna doesen't work very well on metal doors because of the shielding affect. Our testing indicated this is a problem. Gravity type and mercury type switches are prone to error due to shock and errupt motion. Gravity type switches are costly to build and maintain.

U.S. Pat. No. 4,287,514 issued Sep. 1, 1981 to Wartman et al. illustrates a signaling device for being coupled to a mailbox of the type having a cantelievered tongue section defined below the mailbox door hinge. A snap-type single pole single throw (SPST) push on push off action switch is coupled to the base of the mailbox adjacent to the tongue section of the door for generating a first signal responsive to the operative communication between the tongue section to the door as the door is opened. An electrical circuit is coupled to the switch for generating a sensory perceptible signal responsive to receiving the first signal from the switch. The switch is mounted on a generally U-shaped bracket which may be deformable as the switch is being actuated, thereby reducing the possibility of damage to the switch as the door is opened.

The snap action switch would be prone to environmental damage. The external wiring required for this device would be very costly, Another disadvantage of this device is the manufacturing cost would he high because non standard parts are used.

U.S. Pat. No. 4,520,350 issued May 28, 1985 to Huang illustrates a invention relating to a mail box alarm system arranged to notify the owner of a rural mail box when mail has been received. A transmitter positioned in the mail box radiates a coded signal each time the door of the box is opened or closed. A receiver, positioned in the associated residence or business, operates a visual and audible alarm. When mail is delivered, both the visual and audible alarm are energized during the time the door is open for delivery of mail. When the door is closed, only the visual alarm remains energized, When the mail is picked up, the visual alarm is automatically deenergized and the mechanism repositioned for a new cycle. This Device requires an external antenna which would be subject to vandalism and damage from snow plowing. This design would require F.C.C. approval which is very costly. This design has too many components to be commercially successful. also the manufacturing cost would be high due to the use of non standard parts. This device decreases the volume inside the mail box which is not permitted by U.S. postal standards.

U.S. Pat. No. 4,633,236 issued Dec. 30, 1986 to Buhl illustrates mailbox including an indicator indicating the presence of mail, if any, and including a detector having a transmitting and receiving ultrasonic transducer. The transducer transmits ultrasonic waves into the mail box and based on the received ulrasonic waves indicates alterations in the reflected energy. In this manner mail in the mailbox is detected even if the mail does not take up much room. The detector detects alterations in the frequency as a consequence of movements in the mailbox or detects alterations in the pattern of reflection an mail in the mailbox is disturbing the propagation paths of ultrasound in the mailbox. This device is prone to high manufacturing costs as compared to using a simple switch operated by the door of the mail box. Another disadvantage is the inverter operates at 400 volts which is too high and could cause shock to a "Do it your self" service person.

U.S. Pat. No. 4,794,377 issued Dec. 27, 1988 to Benages illustrates a signal to indicate deposit of mail in a box remote from a residence employs an optical reflective dectector which senses presence of mail in the box. The transmission may be r.f. if the box is relatively isolated from other boxes. In apartments, condominiums, and the like where multiple boxes are centrally located, transmission may be by special wiring or by imposing a coded signal on house electrical wiring, Means is provided for the detector distinguising between outgoing mail deposited in the box and new incoming mail. This device is prone to high manufacturing costs as compared to using a simple switch operated by the door of the mail box. This device decreases the volume inside the mail box which is not permitted by U.S postal standards.

U.S. Pat. No. 4,868,543 issued Sep. 19, 1989 to Binkley illustrates A remote mailbox alarm system comprising a mail box unit and a house module is disclosed. The mail box unit comprises a position, sensitive door switch which activates a timer circuit located on an insert board insertable inside mailbox. When activated, mail sensing circuit energized a light-emitting diode to emit infrared light waves that reflect off mail placed inside mail box and onto phototransistor which thereby causes the transmitter switch to energize the transmitter. The door switch is opened, the timer circuit allows the transmitter to continue transmitting for a predetermined period of time. Signal from transmitter are received by a receiver circuit which activates a speaker and a lamp. When the timer circuit times out, the speaker is deactivated while lamp continues lit until de-energized by the pushing of reset switch. This device is prone to high manufacturing costs as compared to using a simple switch operated by the door of the mail box. Another disadvantage is the device is prone to alignment problems and would be difficult to service.

U.S. Pat. No. 5,023,595 issued Jan. 11, 1991 to Bennett illustrates remote solar powered radio frequency transmitter assembly and radio receiving and signaling system to indicate delivery of mail, The transmitter means is powered by a rechargeable battery system which is normally recharged by solar cells located on the transmitter mean housing. The transmitter means comprises an FM radio transmitter operating in the 49 Mhz band, with a signal strength sufficient to providing an alarm signal to receive at least 4,200 feet distant over unbroken terrain. Upon opening of the mailbox door approximately 3 degrees (30) a switch initiates a six (6) second operation of the transmitter means. A receiver is provided to detect the radiated signal, and to energize visual and audible signals in response thereto. Ten position DIP switches are provided at both transmitter means and receiver to vary the frequency of operation so as to minimize or eliminate interfering signals. The transmitter means is secured to the mailbox by a single attachment post. A Jack plug_and flexible cord ore provided to connect the transmitter means and the switch. The switch is provided with a flat backing plate having a double sided adhesive for ease of installation. The audible alarm at the receiver comprises a digitally generated musical tuns, The musically tune automatically stops after about 20 seconds, unless the receiver is reset sooner. Reset of the receiver turns off both the musical tune audible alarm and the flashing light visual alarm, This device is prone to very high manufacturing cost due to high number of parts. Solar panels are also prone to dirt collecting on the surface and decreasing their efficiency.

It's significant that the prior art identified above does not address a variety of details disclosed herein which we feel are necessary to facilitate quick, easy, installation to existing mail boxes by persons with minimum, basic skills. Many of the designs disclosed in the prior art that we searched are considerably more complex than we consider desirable, especially from a manufactureing perspective or a user's viewpoint. A "Do it your self" home owner would have considerable difficulty using many of these designs, let alone afford them.

To summarize the problems of the prior art:

a—Some have an excessive number of parts.

b—Some are difficult to assemble.

c—Some require excessive amount of wiring.

d—Some are subject to enviromental damage.

e—Most designs that use radio frequency transmitters would require F.C.C. approval thus eliminating the advantage of using "Off the shelf", F.C.C. approved, commercially successsful Transmitters.

f—Some designs would not meet U.S. Postal standards because of signaling equipment placed inside the mail box.

g—Many designs would be too costly to build.

h—None of the designs considered the visual impaired person if the first audible signal was not heard. Also none of the devices provided a signal for the person with both visual and hearing disabilities.

i—None of the designs provided a method of frequency receiver in a optimum location in business place, locating the radio in the residence or business place.

SUMMARY OF THE INVENTION

The object of this invention is to present a novel assembled device using a commercial successful, F.C.C approved transmitter and receiver, a commercial successful rural type mail box approved by the U.S. Postmaster General and a simple shaped, resilient strip (VEE spring) used for operating the transmitter.

Another object of this invention is to enable the "DO IT YOUR SELF" homeowner to modify his mail box in a manner that complies with F.C.C and U.S Rural mail box Standards.

Another object of this invention is to assist handicap persons to know when their mail is delivered in order to avoid unnessary trips to the mail box.

Another object of this invention is to provide a method to locate the radio frequency receiver in the best location to receive the strongest signal. In our testing and research work, it was found that proper location of the receiver is extremly important to prevent obstruction to the high frequency, coded radio frequency due to metal located in the walls of the residence or business place.

Another object of this invention is to invent a mail signaling device which is low cost easy to build, and uses commercially available, F.C.C. radio frequency transmitters and receivers and rural mailboxes approved by the U.S. Postmaster General.

Further objects and advantages of our invention will become apparent from a consideration of the drawings and ensuing description.

Our invention provides a system for remotely sensing the delivery of mail to a mailbox having a door that open and closes. The system comprises a transmitter adapted for mounting on the mailbox. The transmitter includes a contact switch element. A transmitter circuit is coupled to the switch element for transmitting a prescribed signal in response to contact with the switch element. The system also includes an actuator adapted for mounting on the mailbox away from contact with the switch element when the door of the mailbox is closed. The actuator moves into contact with the switch element when the door of the mailbox is opened.

The system further includes a receiver adapted for placement at a location remote from the transmitter. The receiver includes two receiver circuits.

The first receiver circuit generates a mail arrival output in response to receipt of the prescribed signal from the transmitter. The first receiver circuit includes a hold element that, following generation of the mail arrival output, maintains the generation of the mail arrival output regardless of continued receipt of the prescribed signal, until receipt of a prescribed termination command. The first receiver circuit also includes an input element that generates the termination command only in response to prescribed input from a user. The mail arrival output indicates when the mailbox door has been opened.

The second receiver circuit generates a receiver locator output separate from the mail arrival output in response to receipt of the prescribed signal from the transmitter. The second receiver circuit includes a time delay element that automatically terminates the receiver locator output in the absence of receipt of the prescribed signal after a predetermined time period. The receiver locator output indicates when the receiver is placed in the remote location for good reception of the prescribed signal.

BRIEF DESCRIPTION OF THE DRAWINGS

Our invention may be more clearly understood by reference to the accompanying drawings:

FIGS. 2–7 show various methods of mounting the transmitter to the bottom of the mailbox.

FIGS. 8–11 are cross sections "X—X" of FIG. 1 illustrating the operation with various shapes of doors.

FIGS. 12–19 illustrate various styles of a VEE spring used in the invention.

FIG. 20 Is a modified cross section "X—X" OF FIG. 1. This section shows the application of the"transmitter operating VEE spring" when used with a straight, bottom section of a mailbox door. The VEE spring is changed to FIG.15.

FIG. 21 Is a modified cross section "X—X" of FIG. 1. This section shows the application of the "transmitter operating VEE spring" when used with a 90 degree, flanged, bottom section of a mail box door. The VEE spring is changed to FIG. 18.

FIG. 22 Is a modified cross section "X—X" OF FIG. 1. This section shows the application of the "transmitter operating VEE spring" when used with a quarter round, bottom section of a mail box door. The VEE spring is unchanged but the base is molded with a pocket for the VEE spring.

FIG. 23 Is a modified cross section "X—X" OF FIG. 1. This section shows the application of the "transmitter operating VEE spring" when used with a reverse, half round, bottom section of a mail box door. The VEE spring is changed to FIG. 19 and the base has a molded dimple added to the base to hold the VEE spring.

FIG. 24 Is a modified cross section "X—X" OF FIG. 1. This section shows the application of the "transmitter operating VEE spring" when used with a straight, bottom section of a mail box door. The VEE spring is changed to FIG. 14.

FIG. 25 Is a modified cross section "X—X" OF FIG. 1. This section shows the application of the "transmitter operating VEE spring" when used with a 90 degree, flanged, bottom section of a mail box door. The VEE spring is changed to FIG. 17.

FIG. 26 Is a modified dross section "X—X" OF FIG. 1. This section shows the application of the "transmitter operating VEE spring" when used with a quarter round, bottom section of a mail box door. The VEE spring is changed to FIG. 16 and the base in molded with a pocket for the VEE spring.

FIG. 27 Is a modified cross section "X—X" OF FIG. 1. This section shows the application of the "transmitter operating VEE spring" when used with a reverse, half round, bottom section of a mail box door. The VEE spring is changed to FIG. 13 and the base has a molded dimple added to the base to hold the VEE spring.

FIG. 28 in a standard garage door operator radio frequency, coded receiver.

FIG. 29 is a assembly of the signaling electronics mounted in a separate cabinet. The receiver is fastened to it.

FIG. 30 is a miniature garage door operator radio frequency, coded transmitter. It is called a key chain type in the industry.

FIG. 31 is a standard, miniature, garage door operator radio frequency, coded transmitter.

DESCRIPTION OF THE PREFERRED EMBODIMENTS

Figure 1:
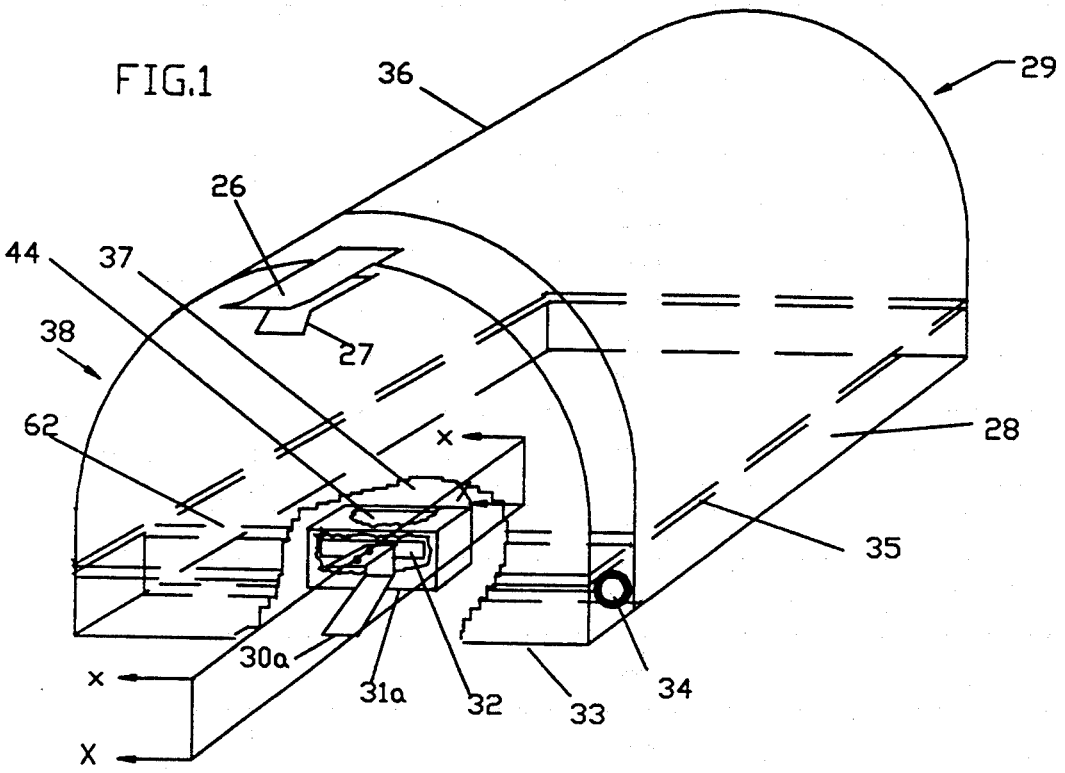
FIG. 1 is a perspective view showing a miniature radio frequency transmitter located underneath the base of a rural mailbox and in close proximity to the bottom surface of the mailbox door.

The first preferred embodiment of our invention is shown generally in FIG. 1 as a radio, high frequency transmitter 44, which in all cases of this invention are located below the base 35 securely attached to a commonly available curbside/roadside, front yard mailbox, generally the rural type approved by the U.S. Post Master General. The mailbox illustrated generally as 29, includes a generally rectangular base 35, having connected to it a curved side and top section of a container 36. The sides of the container 36 extend downwardly beyond the base 35, in order to define a rectangular recessed area 28. This is generally designed into the base of the mailbox by the manufacturer to strengthen the base 35. One end of the mailbox is usually enclosed while the other end generally defines an entryway 37, into the cavity that volume between the base 35, and the container 36. The movable door, illustrated generally an 38, is movable coupled over the entryway of the mailbox 29, in order to provide an environmental seal and maximum protection against dust, freezing rain, sleet or snow and freezing weather and other foreign material from the inside of the container. The door 38, is fastened on both sides coupled by a pair of holes 42, located below the base 35, in that section of the side of the container which extends downwardly beyond the base and coupled with a small, short shaft that accommodates the low friction, operating, pivotable hinge 34. Since the door hinge 34, pivot is located below the base, the door 38, folds down towards the front and the lower section of the mailbox 29. The bottom section of the door generally shown as door 38 in shown in greater detail in FIG. 8 door 38*a*, FIG. 9 door 38*b*, FIG. 10 door 38*c* and FIG. 11 38*d* which we found to be most represented by the most popular U.S. Post Master General approved rural type mailboxes. A bottom section of these popular door shapes extend below the horizontal level of the pivotable hinge 34, and defines a tongue or cantilevered section shown in section details in FIG. 8, FIG. 9, FIG. 10 and FIG. 11. The tongue section of these doors moves in a rearward direction as these popular doors are opened for inserting mail in the cavity. A latch 27, secured to the top of the mailbox door 38, resistively couples with a mating latch 26, attached to the top of the container 36. Many of the modern fully plastic molded mailboxes have molded, restrictive, projection posts that add restriction between the door and the container and no external latches are required to keep the mailbox door closed.

It is to be noted that the most commonly available curbside/roadside mailbox doors include in some form or other, the tongue sections shown in FIG. 8, FIG. 9, FIG. 10, and FIG. 11, and the recessed rectangular 28, below the base 35, It will therefore be obvious to one skilled in this art that various forms of similarly constructed mailboxes may also be adapted to receive the mail box transmitter mounting and operating components, as generally shown in FIG. 8, FIG. 9, FIG. 10, and FIG. 11.

FIG. 1 shows the radio high frequency transmitter 44 which is in its own case consisting of a high frequency electronic transmitting circuit, a pushbutton switch and a battery, This assembly has been certified by the F.C.C. and when used without any modification can be mounted as shown without the necessity of re-testing and re- certification by the F.C.C. This permits the user to use "off the shelf" readily available, low cost transmitters that are used in the garage door opening industry. This assembly is shown in FIG. 1 and inserted in another enclosure 31a which is secured to the bottom of the mailbox base 35. Generally this is done by using screws or wire ties. Wire ties are used in the electrical wiring industry for securing wires and can be used here equally successfully. The enclosure 31*a* is located in close proximity to the tongue section of the door 38. A cutout in the face of the enclosure facing the door 38 is located to suit the location of the pushbutton located on adjoining face of the transmitter case. A generally shaped transmitter operating VEE spring 30*a* is shown, in close proximity to the enclosure 31*a*. When the tongue section of the door pushes against the VEE spring 30*a* it forces the vertical surface of the VEE spring to move toward the transmitter 44, pushbutton 32 and upon "contact make" of ~~the~~ transmitter pushbutton switch 32. The transmitter sends out a high frequency coded signal to the receiver 84 (FIG. 28) located in the residence or business place.

It is to be noted that there are many different forms and designs of enclosures 31*a* that can be used with our novel, low cost VEE spring application. To demonstrate a few designs in order to facilitate the use of our invented VEE spring 30*a,c,d,e,f,* the following FIG. 2, FIG. 3, FIG. 4,. FIG. 5, FIG. 6 and FIG. 7 are presented.

It will become obvious to one skilled in this art that various other forms of similarly constructed enclosures could be designed to facilitate application of our VEE spring.

It is especially important to note that all enclosures 31*a*, 31*b*, 31*c*, and all fabricated components used for enclosures must be, and are, made from non electrical conducting material. Any electrical conducting material in the path of the high frequency coded, magnetically transmitted signal will appreciably attenuate the transmitted coded radio frequency signal.

The transmitter used in this invention is of the garage door opener type. It consists of a electronic high frequency transmitting circuit usually a tuned inductor, capacitor, parallel circuit a pushbutton switch and a 12 volt d.c. battery. These three main components are placed in a plastic case. No external antenna is required. In the Garage door opening industry the transmitter plus the case is called the transmitter 44, and the pushbutton switch is referred to as the pushbutton 32.

In our, invention this transmitter(case) 44, is held in restraint under the mail box base 35 with either a pre molded or fabricated enclosure or fabricated clamping and tieing components.

FIG. 2 is a view of the under side of a mailbox 29, the enclosure 31*b* is a plastic, non conducting, material molded in the general shape as shown. The enclosure 31*b*, is pre molded to fit over the transmitter 44. Wing screws 43 are used to secure the enclosure 31*b* to the base 35. A cutout 41, is molded into the face of the enclosure 41 that faces the door 38 to provide operating moans for the transmitter 44, pushbutton 32. Circles 40, can be drilled holes to fasten a VEE spring 30*a,c,d,e,f,* to the mailbox 29, base 35, or the circles 40 can be small molded projecting dimples for locating and securing a VEE spring 30*a,c,d,e,f,* during a epoxy glueing operation.

FIG. 3 is a view of the under side of a mailbox 29, the enclosure 31*c* is a plastic, non conducting, material molded in the general shape as shown. The enclosure 31*c*, is pre molded to the underside of the base 35, with a cavity to fit the transmitter case. A cutout 41, is molded into the face of the enclosure 31*c*, that faces the door 38 to provide operating means for the transmitter pushbutton 32. Circles 40, can be drilled holes to fasten a VEE spring 30*a,c,d,e,f,* to the mailbox 29, base 35, or the circles 40 can be small molded projecting dimples for locating and securing a VEE spring 30*a,c,d,e,f,* during a epoxy glueing operation. The enclosure 31*c* has dimples 45, molded into the and of enclosure 31*c*. These dimples 45, snap into the holes 47, on the end of the U shaped cover 46, when the cover is placed over the enclosure 31*c*, and secure the transmitter 44.to the base 25.

FIG. 4 in a view of the under side of a mailbox 29. A fabricated enclosure for securing the transmitter 44, to the base 35 consists of 4 fabricated parts. A plastic angle 53, is secured to the base 35, with epoxy glue. A plastic angle 51, is secured to the base with epoxy glue. A cutout 41, is located in the angle 51, facing the door 38, to provide operating means for the transmitter pushbutton 32. Circles 40, can be drilled holes to fasten a VEE spring 30*a,c,d,e,f,* to the mailbox 29, base 35 or the circles 40, can be small molded projecting dimples for locating and securing a VEE spring 30*a,c,d,e,f,* during a epoxy glueing operation. The Z shaped "hold down clips" 52, have resilient properties so that the transmitter 44, can be inserted by spreading out the Z clip 52, until the transmitter 44, can be snaped in to place. The Z clips 52, are secured to the base 35, of the mailbox 29, with screws or epoxy glue.

FIG. 5 is a view of the under side of a mailbox 29, This method for securing the transmitter 44, is for the person with minimum experience with tools or fabricating techniques. Four (4) holes 58, are located in the base 35. A thin MYLAR, resilient, weatherproof tape 56, is wrapped around the transmitter 44, covering the transmitter pushbutton 32, thus weatherproofing the transmitter 44. The transmitter 44, is secured t the base 35, with mylar wire ties 57. These MYLAR wire ties 57, are strong Circles 40, can be drilled holes to fasten a VEE spring 30*a,c,d,e,f,* to the mailbox 29, base 35 or the circles 40, can be small molded projecting dimples for locating and securing a VEE spring 30*a,c,d,e,f,* during epoxy glueing operation.

FIG. 6 is a view of the under side of a mailbox 29. A re-inforcing structural member 62, is shown molded to the base 35, and the sides 6. This is common in several modern U.S. Post Master General approved, plastic molded mailboxes. This gives considerable strength to the under side of the mail box and this structural member 62, is an ideal member to use for attaching the transmitter 44. A cutout 41, is located in the member 62, facing the door 38, to provide operating means for the transmitter 44, pushbutton 32. Circles 40, can be drilled holes to fasten a VEE spring 30*a,c,d,e,f,* to the mailbox 29 base 35 or the circles 40, can be small molded projecting dimples for locating and securing a VEE spring 30*a,c,d,e,f,* during a epoxy glueing operation. The transmitter 44, is positioned behind the member 62, and held in place with Z plate 64, and wing screws 61, and nuts 63. The wing screws are located in close proximity to the transmitter to prevent lateral movement. This is a very easy to build, low cost assembly.

FIG. 7 is a view of the under side of a mailbox 29. A reinforcing structural member 62, is shown molded to the base 35, and the sides 60. This is common in several modern U.S. Post Master General approved, plastic molded mailboxes. This given considerable strength to the under side of the mail box and this structural member 62, is an ideal member to use for attaching the transmitter 44.

A cutout 41, is located in the member 62, faceing the door 38, to provide operating means for the transmitter 44, pushbutton 32. Circles 40, can be drilled holes to fasten a VEE spring 30*a,c,d,e,f,* to the mailbox 29, base 35 or the circles 40, can be small molded projecting dimples for locating and securing a VEE spring 30*a,c,d,e,f,* during a epoxy glueing operation. The transmitter 44, is positioned behind the member 62, and held in place with the "two (2) side open cavity" 66. Wing screws 65, and nuts 67, are used to hold this assembly together. This is a also a very low cost assembly, and easy to build.

A very unique, novel embodiment of our invention is the VEE spring. It is to be noted that there are many different forms and designs of our VEE springs presented as shown in FIG. 12, FIG. 13, FIG. 14, FIG. 15, FIG. 16, FIG. 17, FIG. 18, FIG. 19, FIG. 39, FIG. 40, FIG. 41, FIG. 42, FIG. 43, FIG. 44, and FIG. 45.

It will become obvious to one skilled in this art that various other forms of similarity constructed VEE springs could be designed to facilitate application in our mail signaling invention, which we trust will not deteriate the spirit of our novel invention.

These novel, invented VEE springs FIG. (12–19 inc., 39–45 inc.) have major similar characteristics. The major, similar characteristics are as follows:

They all have:

1—A mounting surface 3OS1, which can be in the same plain as the vertical surface 3OS2, or generally at 90 degrees to the vertical surface 3OS2.

2—A vertical surface 3OS2, which is the main conveyance for transfering a horizontal force to the transmitter 44, pushbutton 32.

3—A nose surface 3OS3, for making contact with the bottom tongue section of the door 38.

4—A general surface 3OS2, connected to the general nose surface 3OS3, both shown in FIG. 12, which form a general wide angle VEE(V) shape with the vertex 59, of this angle, pointing generally in the direction of the transmitter 44, which has its pushbutton facing the vertex 59.

5—A nose surface 3OS3, which is that part of the VEE spring that generally makes contact with the door tongue during a door operation.

6—A nose surface 3OS3, that makes contact with the tongue of a door 38 immediately with minimum movement of the door, in a door opening operation. When this contact accurs in the door opening operation it transfers a force action to the pushbutton 32, of the transmitter 44, and causes a radio frequency coded signal to be sent out by the high frequency magnetic wave of the transmitter 44. A receiver 84, located in the residence or business is tuned to this same coded magnetic wave and it also initiates a control signal to the mail arrival electronic, control circuit FIG. 32. This receiver 84, can be located several hundred feet from the transmitter 44.

It is important that the transmitter 44 pushbutton be engaged as soon as the door begins to move be cause in our research we discovered that the mail delivery person doesn't open the door far when delivering only one piece of mail.

These VEE springs may generally be made of medium temper, spring steel or similar steel with good resilient proportion. However we found in our research that standard cold roll steel, 23 gauge thick and ⅝ inch wide worked very well with our invention because of the close matching of the geometry of the tongue surface, the bottom surface of the door 38, and the geometry of the VEE spring surface 3OS3. If spring steel is used for manufacturing the VEE springs, a lighter gauge spring steel could be used.

The tongue surface of a plastic molded mailbox door 38, experienced very minor wear during life testing with steel VEE springs.

The VEE spring would work, equally well, if made from a resilient plastic of heavier gauge. In our research we found that 1/16" thick molded plastic 1 ½" wide had excellent resiliency. The thicker material is shown in FIG. (8–11 inc.) FIG. (20–24 inc.) and FIG, (33–35 inc.). FIG. (12–19 inc.) are a group of different shaped VEE springs. They may be made from thin metal strips, generally ⅝" in width. The geometry of the shapes are easily formed in a high production setting with low cost stamping dies. The wide open VEE(V) shape is formed by the intersecting surfaces 3OS2 and 3OS3. The vertex 59, is a generally defined geometric characteristic . In some cases the vertex 59, could have a generally curved vertex and we trust that will not affect the spirit of our invention. Surface 3OS1 is the surface used for mounting the VEE spring to the under side of the mailbox. The Surface 3OS1 is generally perpendicular to the vertical surface 3OS2 but also for some applications mounting surface 3OS1, may be in the same plain as vertical surface 3OS2. All the VEE spring designs shown are easy to manufacture and are low in price. These VEE springs can also be easily formed with a standard pair of pliers. In our testing program, we made a few using this method and they worked great. A "Do it your self home owner" with minimum mechanical experience can make a VEE spring using this method. Even after the home made VEE spring is mounted underneath the mailbox 29, it can be "finish adjusted" to perform the correct motion when the mailbox door 29, is operated.

FIG. 8 Is a cross section "X—X" OF FIG. 1. This section shows the application of the "transmitter operating VEE spring" 30*a* when used with a straight, bottom section mail box 29, door 38*a*. When the door is operated, the VEE spring 30*a* surface 3OS3, moves rear-ward placing a horizontal force on eyelet 80. The eyelet moves in the close fitting hole in support member 62. The eyelet then forces pushbutton 32, to operate and the transmitter sends out a high frequency coded signal to the receiver. The close fitting hole is an effective bearing surface. The VEE spring 30*a*, is located on the longitudinal center line of mailbox 29. The transmitter 44, is secured to the bottom of the mailbox base 35, with plastic Z plate 64.

When the nose surface 3OS3 of the VEE spring is contacted by the tongue surface (bottom cantilevered section of mail box door) during a door opening operation by the mail delivery person, the VEE spring moves rearward. The nose surface 3OS3, moves rearward and also the generally formed vertical surface 3OS2, also moves rearward causing the transmitter 44, pushbutton, to operate and send out a coded radio high frequency magnetic wave to the receiver 84. In this operation the VEE spring is slightly distorted but because of its resilient properties, it recovers its original form after the mail box door 38, is closed.

FIG. 9 In a cross section "X—X" OF FIG. 1 This section shows the application of the "transmitter operating VEE spring" 30*a* when used with 90 degree, flanged, bottom section of a mailbox 29, door 38*b*, When door is operated, the VEE spring 30*a* surface 3OS3 moves rear-ward placing a horizontal force on pin 81. The pin 81, moves in the close fitting hole in support member 62. The pin 81, then forces pushbutton 32, to operate and the transmitter sends out a high frequency coded signal to the receiver. The close fitting hole is an effective bearing surface. The VEE spring 30*a*, is located on the longitudinal center line of mailbox 29. The transmitter 44, is secured to the bottom of the mailbox base 35, with plastic Z plate 64.

When the nose surface 3OS3 of the VEE spring is contacted by the tongue surface (bottom cantilevered section of mail box door) during a door opening operation by the mail delivery person, the VEE spring moves rearward. The nose surface 3OS3, moves rearward and also the generally formed vertical surface 3OS2, also moves rearward causing the transmitter 44, pushbutton to operate and send out a coded radio high frequency magnetic wave to the receiver 84. In this operation the VEE spring is slightly distorted but because of its resilient properties, it recovers its original form after the mail box door 38, is closed.

FIG. 10 Is a cross section "X—X" OF FIG. 1. This section shows the Application of the "transmitter operating VEE spring" 30*a* when used with a quarter round bottom section of a mailbox 29, door 38*c*, When the door is operated, the VEE spring 30*a* surface 3OS3 moves rear-ward placing horizontal force on eyelet 80. The eyelet moves in the close fitting hole in support member 62. The eyelet then forces pushbutton 32, to operate and transmitter 44, sends out its high frequency coded signal to the receiver The close fitting hole is an effective bearing surface. The VEE spring 30*a*, is located on the longitudinal center line of mailbox 29. The transmitter 44, is secured to the bottom of the mailbox base 35, with plastic Z plate 64.

When the nose surface 3OS3 of the VEE spring is contacted by the tongue surface (bottom cantilevered section of mail box door) during door opening operation by the mail delivery person, the VEE spring moves rearward. The nose surface 3OS3, moves rearward and also the generally formed vertical surface 3OS2, also moves rearward causing the transmitter 44, pushbutton to operate and send out a coded radio high frequency magnetic wave to the receiver 84. In this operation the VEE spring is slightly distorted but because of its resilient properties it recovers its original form after the mail box door 38, is closed.

FIG. 11 Is a cross section "X—X" OF FIG. 1 This section shows the application of the "transmitter operating VEE spring" 30*a* when used wit a reverse, half round bottom section of a mailbox 29, door 38*d*. When door is operated, the VEE spring 30*a* surface 3OS3 moves rearward placing horizontal force on eyelet 80. The eyelet moves in the close fitting hole in support member 62. The eyelet then forces pushbutton 32, to operate and transmitter 44, sends out a high frequency coded signal to the receiver The close fitting hole is an effective bearing surface. The VEE spring 30*a*, is located on the longitudinal center line of mailbox 29. The transmitter 44, is secured to the bottom of the mailbox base 35, with plastic Z plate 64.

When the nose surface 3OS3 of the VEE spring is contacted by the tongue surface (bottom cantilevered section of mail box door) during a door opening operation by the mail delivery person, the VEE spring moves rearward. The nose surface 3OS3, moves rearward and also the generally formed vertical surface 3OS2, also moves rearward causing the transmitter 44, pushbutton to operate and send out a coded radio high frequency magnetic wave to the receiver 84. In this operation the VEE spring is slightly distorted but because of its resilient properties, it recovers its original form after the mail box door 38, is closed.

FIG. 20 Is a modified cross section "X—X" OF FIG. 1. This section shows the application of the "transmitter operating VEE spring" when used with a straight, bottom section mail box 29, door 38*a*, The VEE spring is changed to FIG. 15 (VEE spring 30*d*). When the door is operated, the VEE spring 30*d* surface 3OS3, moves rear-ward placing a horizontal force on pushbutton 32. The transmitter 44, sends out a high frequency coded signal to the receiver. The cutout in member 62, is made large enough to facilitate free movement for the weld stud 71, The VEE spring 30*d*, is located on the longitudinal center line of mailbox 29.

The transmitter 44, is secured to the bottom of the mailbox base 35, with plastic Z plate 64. When the nose surface 3OS3 of the VEE spring is contacted by the tongue surface (bottom cantilevered section of mail box door) during a door opening operation by the mail delivery person, the VEE spring moves rearward. The nose surface 3OS3, moves rearward and also the generally formed vertical surface 3OS2, also moves rearward causing the transmitter 44, pushbutton to operate and send out a coded radio high frequency magnetic wave to the receiver 84. In this operation the VEE spring is slightly distorted but because of its resilient properties it recovers its original form after the mail box door 38, is closed, FIG. 21 Is a modified cross section "X—X" of FIG. 1. This section shows the application of the "transmitter operating VEE spring" when used with a 90 degree, flanged, bottom section of a mailbox 29, door 38*b*. The VEE spring is changed to FIG. 18 (VEE spring 30*g*) When the door is operated, the VEE spring 30*g* surface 3OS3 moves rear-ward placing horizontal force on pin 81. The pin 81, moves in the close fitting hole in support member 62. The pin 81, then forces pushbutton 32, to operate and the transmitter sends out a high frequency coded signal to the receiver The close fitting hole is an effective bearing surface. The VEE spring 30*g*, is located on the longitudinal center line of mailbox 29. The transmitter 44, is secured to the bottom of the mailbox base 35, with plastic Z plate 64.

When the nose surface 3OS3 of the VEE spring is contacted by the tongue surface (bottom cantilivered section of mail box door) during door opening operation by the mail delivery person, the VEE spring moves, rearward. The nose surface 3OS3, moves rearward and also the generally formed vertical surface 3OS2, also moves rearward causing the transmitter 44, pushbutton to operate and send out a coded radio high frequency magnetic wave to the receiver 84. In this operation the VEE spring is slightly distorted but because of its resilient properties it recovers its original form after the mail box door 38, is closed.

FIG. 22 Is a modified cross section "X—X" of FIG. 1. This section shows the application of the "transmitter operating VEE spring" 30*a* when used with a quarter round bottom section of a mailbox 29, door 38*c*, The base 35*a*, has a molded seat for securing VEE spring FIG. 12 (30*a*). When the door is operated, the VEE spring 30*a* surface 3OS3 moves rearward placing a horizontal force on eyelet BO. The eyelet moves in the close fitting hole in support member 62. The eyelet then forces pushbutton 32, to operate an transmitter 44, sends out a high frequency coded signal to the receiver. The close fitting hole is an effective bearing surface. The VEE spring 30*a*, is located on the longitudinal center line of mailbox 29. The transmitter 44, is secured to the bottom of the mailbox base 35*a*, with plastic Z plate 64. The VEE spring 30*a* is secured in the molded slot in the base 35*a* with epoxy glue.

When the nose surface 3OS3 of the VEE spring is contacted by the tongue surface (bottom cantilivered section of mail box door) during a door opening operation by the mail delivery person, the VEE spring moves rearward. The nose surface 3OS3, moves rearward and also the generally formed vertical surface 3OS2, also moves rearward causing the transmitter 44, pushbutton to operate and send out a coded radio high frequency magnetic wave to the receiver 84. In this operation the VEE spring is slightly distorted but because of its resilient properties, it recovers its original form after the mail box door 38, is closed.

FIG. 23 Is a modified cross section"X—X" OF FIG. 1. This section shows the application of the "transmitter operating VEE spring" when used with a reverse, half round bottom section of a mailbox 29, door 38*d*. The base is changed to base 35*b* and the VEE spring is changed to FIG. 19 ( VEE spring 30*h*) The base 35*b* has a molded dimple 78, for securing VEE spring 30*h*. The VEE spring 3O*h*, in secured to base 35*b*, with epoxy glue. When door 38*d* is operated, the VEE spring 30*h* surface 3OS3 moves rear-ward placing horizontal force on eyelet 80. The eyelet moves in the close fitting hole in support member 62. The eyelet then forces pushbutton 32, to operate and transmitter 44, sends out a high frequency coded signal to the receiver. The close fitting hole is an effective bearing surface. The VEE spring 30*h*, is located on the longitudinal center, line of mailbox 29. The transmitter 44, is secured to the bottom of the mailbox base 35*b*, with plastic Z plate 64.

When the nose surface 3OS3 of the VEE spring in contacted by the tongue surface (bottom cantilivered section of mail box door) during a door opening operation by the mail delivery person, the VEE spring moves rearward. The nose surface 3OS3, moves rearward and also the generally formed vertical surface 3OS2, also moves rearward causing the transmitter 44, pushbutton to operate and send out a coded radio high frequency magnetic wave to the receiver 84. In this operation the VEE spring is slightly distorted but because of its resilient properties, it recovers its original form after the mail box door 38, is closed.

FIG. 24 Is a modified cross section "X—X" of FIG. 1. This section shows the application of the "transmitter operating VEE spring" when used with a straight, bottom section mail box 29, door 38*a*, The VEE. spring is changed to FIG. 14 (VEE spring 30*c*). When the door is operated, the VEE spring 30*c*, surface 3OS3, moves rear-ward placing a horizontal force on pushbutton 32. The transmitter 44, sends out a high frequency coded signal to the receiver. The cutout in member 62, is made large enough to facilitate free movement for the tubular projection of the VEE spring 30*c*. The VEE spring 30*c*, is located on the longitudinal center line of mailbox 29. The transmitter 44, is secured to the bottom of the mailbox base 35, with plastic Z plate 64.

When the nose surface 3OS3 of the VEE spring in contacted by the tongue surface (bottom cantilivered section of mail box door) during a door opening operation by the mail delivery person, the VEE spring moves rearward. The nose surface 3OS3, moves rearward and also the generally formed vertical surface 3OS2, also moves rearward causing the transmitter 44, pushbutton to operate and send out a coded radio high frequency magnetic wave to the receiver 84. In this operation the VEE spring is slightly distorted but because of its resilient properties, it recovers its original form after the mail box door 38, is closed.

FIG. 25 Is a modified cross section "X—X" OF FIG. 1. This section shows the application of the " transmitter operating ZEE spring when used with a 90 degree, flanged, bottom section of a mailbox 29, door 38*b*. The VEE spring is changed to FIG. 17 (VEE spring 30*f*). When the door is operated, the VEE spring 30*f* surface 3OS3 moves rear-ward placing a horizontal force on pin 81. The pin 81, moves in the close fitting hole in support member 62. The pin 81, then forces pushbutton 32, to operate and the transmitter sends out a high frequency coded signal to the receiver. The close fitting hole is an effective bearing surface. The VEE spring 30*f*, is located on the longitudinal center line of mailbox 29. The transmitter 44, is secured to the bottom of the mailbox base 35, with plastic Z plate 64. The "half circle" tip on the tongue surface 3OS3 of VEE spring 30*f*, may be used to expedite a faster transmitter 44, push button 32, operation with very small initial movement of the door 38*b*.

When the nose surface 3OS3 of the VEE spring in contacted by the tongue surface (bottom cantilivered section of mail box door) during a door opening operation by the mail delivery person, the VEE spring moves rearward. The nose surface 3OS3, moves rearward and also the generally formed vertical surface 3OS2, also moves rearward causing the transmitter 44, pushbutton to operate and send out a coded radio high frequency magnetic wave to the receiver 84. In this operation the VEE spring is slightly distorted but because of its resilient properties, it recovers its original form after the mail box door 38, is closed.

FIG. 26 In a modified cross section "X—X" OF FIG. 1. This section shows the application of the "transmitter operating VEE spring" when used with a quarter round bottom section of a mailbox 29, door 38*c*, The base 35*a*, has a molded slot for securing VEE spring FIG. 16 (30*e*). When the door is operated, the VEE spring 30*e* surface 3OS3 moves rear-ward placing a horizontal force on eyelet BO. The eyelet moves in the close fitting hole in support member 62. The eyelet then forces pushbutton 32, to operate and transmitter 44, sends out a high frequency coded signal to the receiver. The close fitting hole is an effective bearing surface. The VEE spring 30*e*, is located on the longitudinal center line of mailbox 29. The transmitter 44, is secured to the bottom of the mailbox base 35*a*, with plastic Z plate 64. The VEE spring 30*e* is secured in the molded slot in the base 35*a* with epoxy glue.

When the nose surface 3OS3 of the VEE spring in contacted by the tongue surface (bottom cantilivered section of mail box door) during a door opening operation by the mail delivery person, the VEE spring moves rearward. The nose surface 3OS3, moves rearward and also the generally formed vertical surface 3OS2, also moves rearward causing the transmitter 44, pushbutton to operate and send out a coded radio high frequency magnetic wave to the receiver 84. In this operation the VEE spring is slightly distorted but because of its resilient properties, it recovers its original form after the mail box door 38, is closed.

FIG. 27 Is a modified cross section"X—X" OF FIG. 1. This section shows the application of the "transmitter operating VEE spring" when used with a reverse, half round bottom section of a mailbox 29, door 38*d*. The base is changed to base 35*b* and the VEE spring is changed to FIG. 13 VEE spring 30*b*) The base 35*b* has a molded dimple 78, for securing VEE spring 30*b*. The VEE spring 30*b*, is secured to base 35*b*, with epoxy glue. When door 38*d* is operated, the VEE spring 30*b* surface 3OS3 moves rear-ward placing horizontal force on eyelet 80. The eyelet moves in the close fitting hole in support member 62. The eyelet then forces pushbutton 32, to operate and transmitter 44, sends out a high frequency coded signal to the receiver. The close fitting hole in an effective bearing surface. The VEE spring 30*b*, is located on the longitudinal center line of mailbox 29. The transmitter 44, is secured to the bottom of the mailbox base 35*b*, with plastic Z plate 64.

When the nose surface 3OS3 of the VEE spring is contacted by the tongue surface (bottom cantilivered section of mail box door) during a door opening operation by the mail delivery person, the VEE spring moves rearward. The nose surface 3OS3, moves rearward and also the generally formed vertical surface 3OS2, also moves rearward causing the transmitter 44, pushbutton to,-operate and send out a coded radio high frequency magnetic wave to the receiver 84. In this operation the VEE spring is slightly distorted but because of its resilient properties, it recovers its original form after the mail box door 38, is closed.

The following six (6) figures are larger sections showing in greater detail, the different methods used to mount the VEE springs. They are FIG. 33, FIG. 34, FIG. 35, FIG. 36, FIG. 37, and FIG. 38. These sections are broadside views of the VEE springs mounted underneath the mail box 29, base 35. The VEE springs are located on the longitudinal center line of the mail box 29. The VEE springs in FIG. (33–35 inc.) are shown in thicker sections simulating plastic construction. The thinner sections shown in FIG. (36–38 inc.) simulate VEE springs made of metal. Plastic or metal VEE springs can be inter changed in these figures without deteriating from the spirit of this invention.

Figure 33:
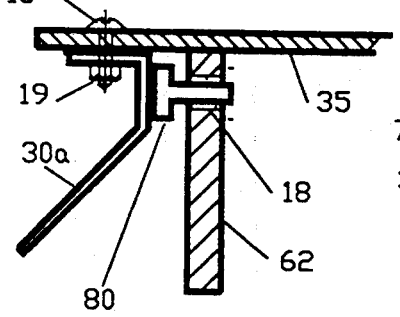
FIGS. 33–38 show various means of mounting the VEE spring on a mailbox.

FIG. 33, shows the VEE spring 30*a* mounted to the bottom of base 35 using screw 15, and nut 19. The eyelet 80, moves freely in the close fitting hole 18.

Figure 34:
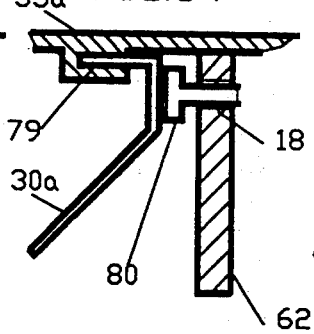

FIG. 34, shows the VEE spring 30*a* cemented to the molded base 35*a*, pocket 79. The pocket 79, also can be molded to smaller dimensions for"force fitting" the VEE spring 30*a* to the molded base 35*a*, pocket 79.

Figure 35:
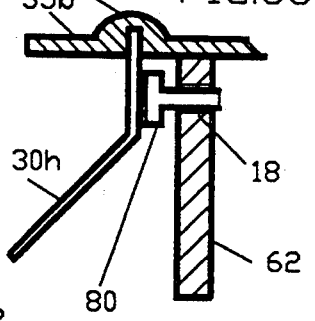

FIG. 35, shows the VEE spring 30*h* cemented to the molded base 35*b*, dimple 78. The dimple 78, also can be molded to smaller dimensions for"force fitting" the VEE spring 30*h* to the molded base 35*b*, dimple 78.

Figure 36:
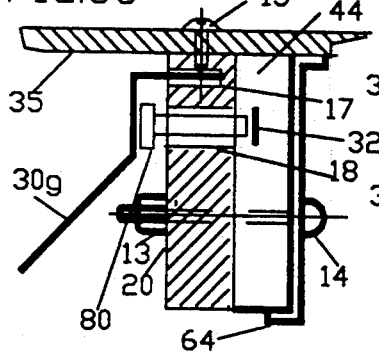

FIG. 36 Shown a VEE spring 30*g*, either cemented or force fitted in a generally small slot 17 in front plate 20. The front plate has a close fitting, hole for the eyelet to have low friction rearward movement when contacted by the VEE spring 30*g*. The transmitter 44, is secured between the end plate 20, and Z member 64 using two screws 14, and two nuts 13. The pushbutton 32, is operated by the rearward movement of the VEE spring 30*g* at first, door opening movement of the mail box 29 door 38.

Figure 37:
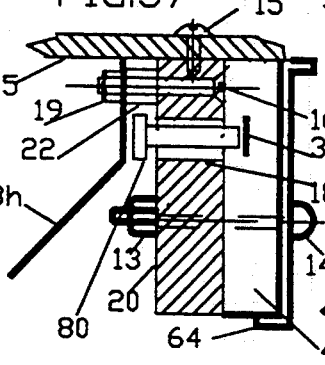

This assembly of VEE spring 30*g*, front plate 20, eyelet 80 and Z member 64 is significant because they form a miniature total assembly that can be used on customer's existing mailbox. All that would be required to mount this assembly to the bottom of a rural type mailbox 29 would be to drill two holes in bottom of mail box thru the base 35, and secure with two screws 15. FIG. 37 is the same as FIG. 36 except VEE spring 30*h* is now used and secured to front plate 20 with screw 16, and nut 19.

Figure 38:
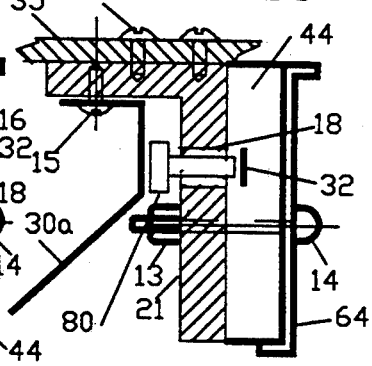
Figure 39:
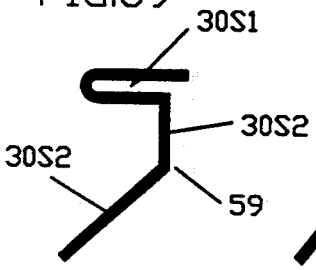
FIGS. 39–45 show various VEE springs that are made from solid circular resilient material.
Figure 40:
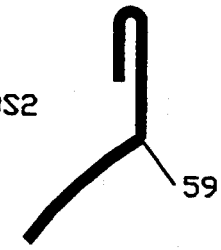
Figure 41:
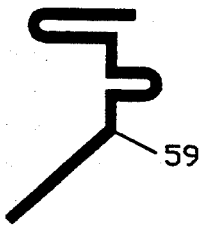
Figure 42:
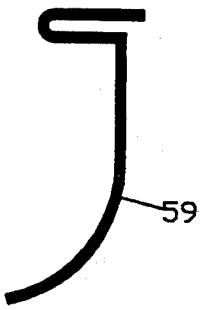
Figure 43:
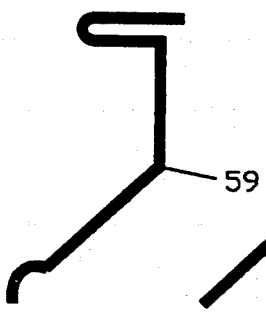
Figure 44:
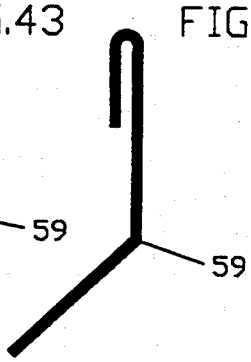
Figure 45:
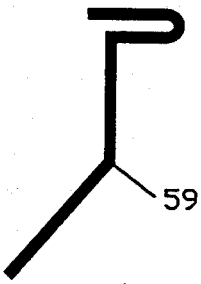

FIG. 38 is the same as FIG. 36 except VEE spring 30*a* is now used and the front plate is now a plastic angle 21. Screw 15, secures VEE spring 30*a* to angle 21 with threaded hole in angle 21. It is to be noted that screws 15 are secured to top of plates 20 and 21 with threaded holes in these members 20, and 21, To assist the analysis of these sections pertaining depth the following is given. The VEE springs are generally 5/81' wide and 23 gauge thick if their composition is metal and generally 1½" wide and 1/16" thick if their composition is plastic. Front plates 20, and 21 are generally 3" long. The screws 14, are spaced apart an amount necessary to prevent lateral movement of transmitter 44. However it is significant to note that the VEE springs can be made from circular spring wire at a very low piece cost and also at very low tooling cost. These types of VEE springs are shown in FIG. ( 39–45 inc.). These VEE springs can be used in identical applications as previously shown in this disclosure. These VEE springs have a novel parallel section 30S1 for mounting means.

Figure 32:
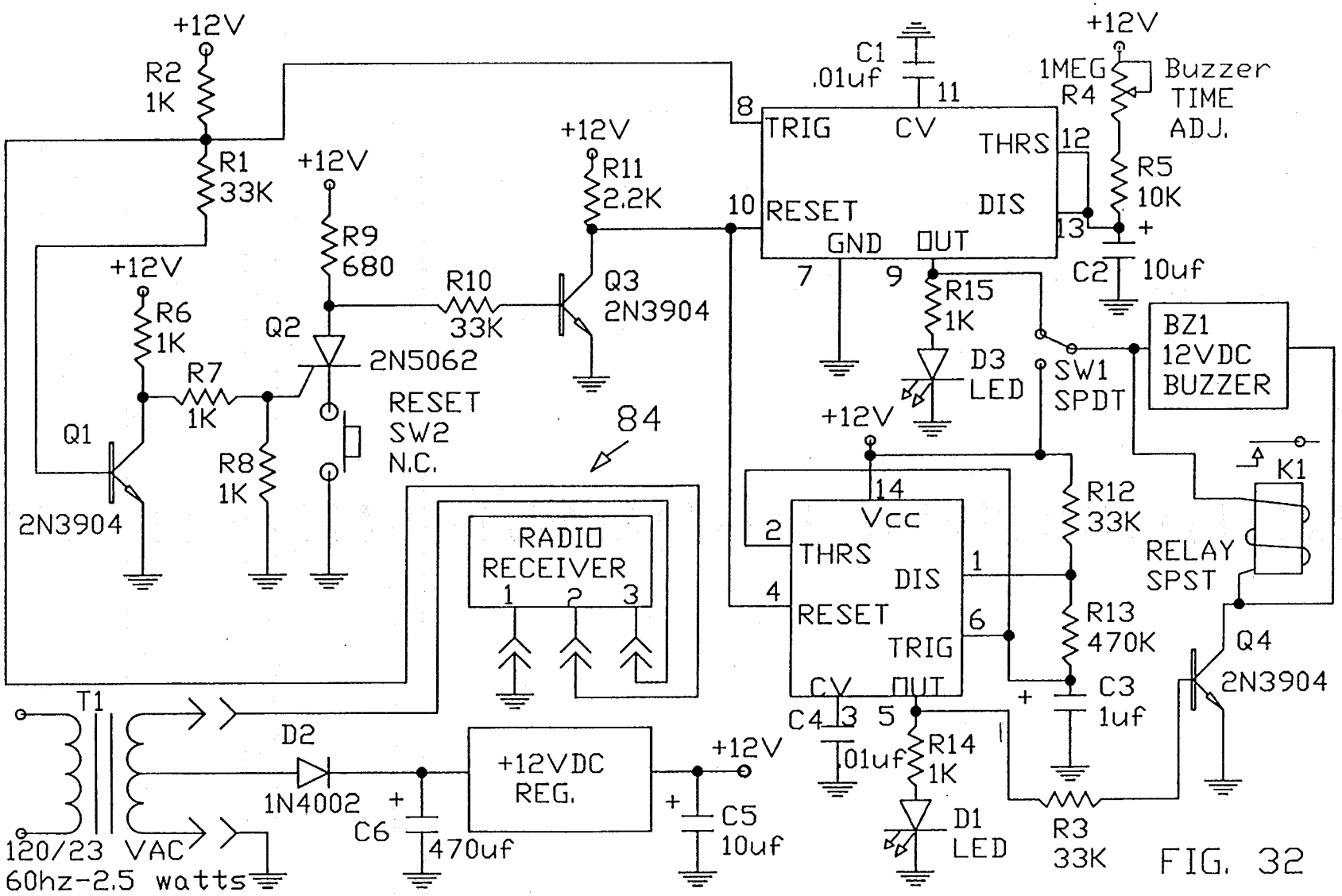
FIG. 32 is the schematic diagram of the electronic circuit that is in its own enclosure and connected to the receiver located in the residence or business place.

FIG. 32 is the schematic diagram of the electronic signaling devices. It consists of the following major circuit elements and devices.

a—control transformer TI, for supplying power to the radio receiver terminals in and 3. The transformer T1 also supplies power to the diode D2 which then driven the 12 volt regulator LM340.

b—regulator LM340 maintains the output voltage to the electronic circuits at a constant voltage of 12 volts D.C..

c—radio receiver 84, of the garage door operating type which is tuned to the same frequency as the transmitter 44 which is located underside the mailbox 29 base 35. The output signal from the receiver comes from terminal 2 and 3. The signal can be either a contact closure or a triac device. Power to the receiver is to terminals 1 and 3. The radio receiver 84, is bolt to the top of control cabinet 96, and located in the residence or business place (see FIGS. 28 and 29).

d—signal inverters Q1 and Q3.

e—SCR Q2 is "the memory hold" semiconductor. It stays on after the radio receiver 84 receives the mail arrival signal from the transmitter 44, and can only be turned off by pushing pushbutton 94 which is designated on the schematic diagram as reset switch SW2.

f—Pushbutton switch 94, labeled SW2, on the schematic FIG. 32 for resetting the mail arrival signal and preparing for the next mail arrival. It is a normally closed contact.

g—diode D2 rectifies the A.C. voltage by half wave rectificatin for driving the 12 volt D.C. regulator.

h—a 556 integrated circuit semiconductor consists of two major circuits. One is labeled Ula and the other Ulb.

I—Ula is a triggered time delay circuit The time delay is determined by potentiometer R4, resistor R5 and capacitor C2. The input signal pin 8, is labeled TRIG. The output signal pin 9, is labeled OUT. This output mail arrival signal energizes:

1—the "receiver locator signal light" 90, labeled LED D3 on the schematic diagram FIG, 32.

2—the buzzer 91, labeled BZ1 on tho schematic diagram FIG. 32.

3—the vibrator relay 92, labeled K1 on the schematic diagram FIG. 32 j—Q4 is a semiconductor switch that anables the buzzer BZ1 and vibrator relay K1—to pulsate during the time delay of Ula.

k—Ulb is an oscillating circuit that triggers Ula to the on state and also causes the "mail arrival light" 93, labeled LED DI on the schematic diagram FIG. 32 to blink when mail has been delivered. It is reset with pushbutton 94, labeled RESET SW2 on the schematic diagram FIG. 32, 1—memory check pushbutton 89, labeled SWI on the schematic diagram FIG. 32 is a single pole double through (SPDT) switch used to check if mail has been delivered and if the visual or hearing impaired person missed the first signal due to being absent from the home or business place when mail was delivered.

m—time delay potentiometer 82, labeled R4 on schematic diagram FIG. 32 This potentiometer 82, is used to vary the time delay circuit of Ula generally from 3 to 180 seconds.

FIG. 32 shows various other resistors R1; R2; R3;R6; R7; R9; R11; R12; R13; R14; and R15 and capacitors C1; C3; C4; C5; and C6 that the electronic signaling device incorporates.

FIG. 28 shows the radio frequency receiver 84, mounted on the mail arrival signaling control cabinet 96, per FIG. 29.

FIG. 30 shows a garage door opener transmitter which is called a key chain type in the industry which also is used in our invention for signaling the arrival of mail in a rural type mail box.

FIG. 31 shows a standard garage door opener transmitter 44, which is used in our invention for signaling the arrival of mail in a rural type mail box.

The operation and functions performed by our novel mail signaling device 44 is detailed as follows:

When mail is delivered to a rural mail box 29, the transmitter either a standard type 44, or a key chain type 97 located underneath the base 35, sends out a high frequency coded signal to the radio frequency receiver 84, located in the residence or business place.

MAIL DELIVERY OPERATION SEQUENCE

1—Mail box opened for mail delivery. As soon as door moves, the transmitter operates and sends out it's high frequency coded signal as long as the mail box is open. The door is closed after mail delivery.

2—Mail arrival light 93. blinks and will remain blinking until reset with pushbutton 94.

3—Receiver" location signal light 89, turns on and remains on for generally 3 to 180 seconds depending on setting of potentiometer 82 or longer if transmitter 44, stay on because door of mailbox was left open.

4—Buzzer 91 sends out a pulsating audible sound signal and remains on for generally 3 to 180 seconds depending on setting of potentiometer 82.

5—Vibrator 92 sends out a mechanical, vibration signal which can be sensed by a person with both hearing and visual impairment. This signal will last generally for 3 to 180 seconds depending on the setting of potentiometer 82. The vibration signal can be sensed with a finger held on the top of the vibrator 92.

6—If the person with visual or hearing impairment or with both visual and hearing impairment missed the first mail delivery signal, which lasted generally 3 to 180 seconds they can recheck if mail was delivered by pressing pushbutton 89. This is possible because of the -novel memory hold circuit of our electronic circuit. This memory hold circuit in due to the SCR Q2,FIG. 32,remaining on after the mail is delivered. This signal can be checked as manny times or as long an the pushbutton 89 is held pressed. The memory check pushbutton 89 and the vibrator 92 are located next to each other oh top of cabinet 96, so that two adjacent fingers can easily press the pushbutton 89 and sense the vibration signal at the same time.

NOVEL TECHNIQUE FOR PRECISION LOCATING THE RADIO RECEIVER IN THE RESIDENCE OR BUSINESS PLACE FOR MAXIMUM SIGNAL RECEPTION.

The energy radiated from the transmitter 44, or 97, located underneath the mail box base 35, is devided into a ground wave traveling in a straight line along the surface of the earth and a sky wave which is propagated in the atmosphere above the earth and because of the high frequency affects this part of the wave is lost when it hits the above atmosphere. The ground wave is the one that concerns us. One half of this ground wave energy is contained in the form of electrostatic energy and the other is in the form of magnetic energy. The ground wave starts from the rural type mail box 29, and travels horizontal in straight lines but as it travels away from the mail box, it becomes weaker as a result of spreading and losses resulted from the fact that the ground induces charges in the earth. These induced charges develop ground current and loses that attenuate the ground wave with distance at a rate determined by the distance the ground wave has to travel to reach the radio receiver 84, antenna 83, the frequency and the reactive characteristics of the earth material at the wave frequency. It is good practice therefore to place the radio frequency receiver as high as possible in the residence or business place and also out of the path of magnetic or conducting material hidden inside walls and other conducting material located in the residence or business place.

When the ground wave reaches the receiver antenna 83,energy is produced in the receiver antenna 83 because the electromagnetic flux of the radio frequency ground wave cuts across the receiver antenna 83. This voltage induced in the receiver antenna 83, is equal to the product of the effective antenna height and the strength of the transmitted wave and the resulting current flowing in the receiver antenna 83.

Since the ground wave is magnetic and travels in a straight line between the transmitter 44, and the radio frequency receiver 84, antenna, 83 it is extremely important that no metal or other conducting material is in this straight line path. Any conducting material especially material with magnetic properties should be avoided.

Our novel invention solves this problem. The "receiver locator signal light" 90 can be used to locate the receiver 44 with its antenna 83 at an optimum location in the residence or business place. During testing of our-mail delivery signaling system, we discovered that our test results were inconsistent. Some days the mail delivery signal would work fine but other days we would miss the mail delivery signal. It was discovered that the location of the receiver 44 with its antenna in the residence or business place was critical. Our invention of the Of receiver locator signal light solved this problem. Here is how it works:

NOVEL TECHNIQUE FOR PRECISION LOCATING THE RADIO RECEIVER IN THE RESIDENCE OR BUSINESS PLACE FOR MAXIMUM SIGNAL RECEPTION.

Steps 1, 2 and 3 for person without visual handicap:

STEP 1: Open the mail box door and let it open so the transmitter sends out a continuous high frequency wave. Set potentiometer 82 for minimum time delay for maximum sensitivity in locating the receiver 84.

STEP 2: Move the receiver 84 located in the residence or business to a location where the "receiver locator signal light" 90 remains on continuous without flickering. If there is any intermittent flickering of this light 90, move the receiver 84, to another location until the best location is found. The location should be marked. We found that one foot lateral movement from the optimum test location gave us intermittent results.

STEP 3: close the door of the mail box 29 and the mail signaling system is ready for mail delivery, Steps 1, 2 and 3 for person with visual impairment.

STEP 1: Open the mail box door and let it open so the transmitter sends out a continuous high frequency wave.

STEP 2: The buzzer 91, can also be used as a "receiver locator signal."—for the person with a visual impairment. Move the receiver 84, located in the residence or business to a location where the buzzer 91, continuously sends out a buzzer audible signal. If there is any irregular intermittent sound emitted from the buzzer 91, move the receiver 84 to another location until the best location is found. The location should be marked. We found that one foot lateral movement from the optimum test location gave us intermittent results.

STEP 3: close the door of the mail box 29 and the mail signaling system is ready for mail delivery.

Steps 1, 2 and 3 for person with both visual and hearing impairment.

STEP 1: Open the mail box door and let it open so the transmitter sends out a continuous high frequency wave.

STEP 2: The vibrator 92, can also be used as a "receiver locator signal" for the person with both visual and hearing impairment. Move the receiver 84, located in the residence or business to a location where the vibrator 92, continuously sends out a vibrating signal that can be sensed by touching the top surface of vibrator 92. If there is any irregular, intermittent vibration sensed from the top surface of vibrator 92, move the receiver 84, to another location until the best location is found. The location should be marked. We found that one foot lateral movement from the optimum test location gave us intermittent results.

STEP 3: Close the door of the mail box 29 and the mail signaling system in ready for mail delivery.

This novel "receiver locating technique" in very important for guaranteeing that a mail arrival system will operate constantly with out missing a mail delivery signal. This is especially important where the distance between the rural mailbox and the receiver is great in the range of 100 to 300 feet and where the transmitted wave has to go thru several walls of the residence or business place. There can be magnetic conducting material inside walls that can be very detrimental to high frequency transmitted waves. Also conducting material in room of resident or machinery located in a business can be detrimental to the transmitted wave if they are located in the wave's path. Our novel technique solves this problem.

What is claimed:

1. A system for remotely sensing the delivery of mail to a mailbox having a door that opens and closes comprising a transmitter adapted for mounting on the mailbox, the transmitter including a contact switch element and transmitter circuit means coupled to the switch element for transmitting a prescribed signal in response to contact with the switch element, an actuator adapted for mounting on the mailbox away from contact with the switch element when the door of the mailbox is closed, the actuator moving into contact with the switch element when the door of the mailbox is opened, and a receiver adapted for placement at a location remote from the transmitter including first receiver circuit means operable for generating a mail arrival output in response to receipt of the prescribed signal from the transmitter including a hold element that, following generation of the mail arrival output, maintains the generation of the mail arrival output regardless of continued receipt of the prescribed signal, until receipt of a prescribed termination command, the first receiver circuit means further including an input element that generates the termination command only in response to prescribed input from a user, whereby the mail arrival output indicates when the mailbox door has been opened, and second receiver circuit means operable for generating a receiver locator output separate from the mail arrival output in response to receipt of the prescribed signal from the transmitter including a time delay element that automatically terminates the receiver locator output in the absence of receipt of the prescribed signal after a predetermined time period, whereby the receiver locator output indicates when the receiver is placed in the remote location for good reception of the prescribed signal.

2.. A system according to claim 1 wherein the receiver locator output comprises at least one signal that is audible, or tactile, or visual.

3. A system according to claim 1 wherein the mail arrival output comprises a visual signal.

4. A system according to claim 3 and wherein the hold element includes status check means operable, in response to a prescribed check status input from the user during the generation of the visual mail arrival output signal, for generating at least one ancillary output that is either audible or tactile.

5. A system according to claim 4 wherein the status check means includes a switch activated by contact by the user to generate the prescribed status check input.

6. A system according to claim 3 wherein the hold element includes means for generating at least one ancillary output that is either audible or tactile for a prescribed time period during generation of the visual mail arrival output signal.

7. A system according to claim 6 wherein the hold element includes an element that the user manipulates to adjust the length of the predetermined time period of the ancillary output generating means.

8. A system according to claim 1 wherein the input element comprises a switch activated by contact by the user.

9. A system according to claim 1 wherein the actuator comprises a generally V-shaped resilient element.

10. A system according to claim 1 wherein the second receiver circuit means includes an element that the user manipulates to adjust the length of the predetermined time period of the time delay element.

11. A system according to claim 1 wherein the predetermined time delay is between about 3 seconds to about 180 seconds.

* * * * *